US008505264B2

(12) United States Patent
Glisko

(10) Patent No.: US 8,505,264 B2
(45) Date of Patent: Aug. 13, 2013

(54) TOOL FOR AND METHOD OF INSTALLING METAL STUD WALL SYSTEM

(76) Inventor: Eyal Glisko, Fair Lawn, NJ (US)

( * ) Notice: Subject to any disclaimer, the term of this patent is extended or adjusted under 35 U.S.C. 154(b) by 291 days.

(21) Appl. No.: 13/012,218

(22) Filed: Jan. 24, 2011

(65) Prior Publication Data

US 2012/0186189 A1 Jul. 26, 2012

(51) Int. Cl.
*E04B 2/76* (2006.01)

(52) U.S. Cl.
USPC ..... 52/745.12; 52/745.21; 52/749.1; 29/255; 29/278; 269/3; 269/6; 269/32

(58) Field of Classification Search
USPC ..... 52/749.1, 745.09, 745.12, 745.21; 72/324, 325, 409.01; 30/123; 269/3, 6, 24, 269/32; 29/244, 255, 270, 278
See application file for complete search history.

(56) References Cited

U.S. PATENT DOCUMENTS

| | | | | |
|---|---|---|---|---|
| 3,536,345 | A * | 10/1970 | Leifer | 52/241 |
| 4,571,975 | A * | 2/1986 | Pawloski et al. | 72/325 |
| 4,805,364 | A * | 2/1989 | Smolik | 52/745.12 |
| 6,557,254 | B1 * | 5/2003 | Johnson | 52/220.7 |
| 6,840,078 | B1 * | 1/2005 | Clover | 72/409.01 |
| 6,983,569 | B1 * | 1/2006 | Rosenberg | 52/241 |

* cited by examiner

*Primary Examiner* — Mark Wendell
*Assistant Examiner* — Matthew J Smith
(74) *Attorney, Agent, or Firm* — Kirschstein, et al.

(57) ABSTRACT

A tool connects a stud in place to a longitudinal track in a metal stud wall system installation. The tool includes a tool head having an upright slot in which a track flange is received and a pair of rams mounted on the tool head for linear movement transversely of the track. The rams are spaced apart and straddle opposite sides of the stud. The rams have leading tips with cutting edges. An actuator moves the rams into cutting engagement with the track flange in the upright slot to cut hinged tabs in the track flange, and to bend the hinged tabs into frictional engagement with the opposite sides of the upright stud to connect the upright stud in place to the track.

16 Claims, 8 Drawing Sheets

TOOL FOR AND METHOD OF INSTALLING METAL STUD WALL SYSTEM

BACKGROUND OF THE INVENTION

This invention generally relates to a tool for, and a method of, installing a metal stud wall system, especially a deflection wall system that permits relative vertical movement between upright metal studs and a metal track secured to a ceiling or overhead framework for an upper floor.

Building construction framing increasingly uses galvanized steel in installing wall systems due to the increased strength and termite resistance of steel compared to wood. In a typical non-load bearing wall installation, an elongated, metal, channel-shaped, bottom track is secured to a floor, an elongated, metal, channel-shaped, top track is secured to a ceiling or overhead framework for an upper floor, and multiple spaced-apart upright metal studs are fixedly secured at their opposite ends to the top and bottom tracks. The studs provide a support structure onto which gypsum wallboards, i.e., drywall, panels, or other wall surface materials can be installed to form a closed wall structure. The studs often include lateral bores or cutouts through which electrical, plumbing, or other conduits can be routed.

To counter bowing, settling and/or cracking of the wall structure arising from overhead loads or other movement of the ceiling or overhead framework being applied to the non-load bearing studs, deflection wall systems have been used to permit relative vertical movement between the studs and the top track. In one such known deflection system, an upper top track is attached to the overhead framework, and a lower top track is nested within the upper track and is attached to the studs. A gap between the two nested top tracks permits vertical movement of the upper track without corresponding movement of the lower track. In another such known deflection system, the top track is connected to each stud by means of a fastener that extends through, and is movable along, a vertical slot to permit the relative vertical movement between the studs and the top track.

As advantageous as these known deflection systems have been, the use and installation of two tracks and the advance manufacture of customized tracks are costly not only in terms of component costs, but also in terms of time and labor. It would be desirable to provide a tool that can readily and easily convert a standard track for use in such a metal stud wall system, as well as a method of quickly and inexpensively installing such a metal stud wall system, especially a deflection wall system.

SUMMARY OF THE INVENTION

One aspect of this invention is directed to a tool for connecting an upright stud in place to a horizontal track having a track web extending along a longitudinal direction and track flanges extending away from the track web in a metal stud wall system installation. The track can be a top track connected to a ceiling or overhead framework and/or a bottom track connected to a floor. The tool includes a tool head having an upright slot in which at least one of the track flanges is received. During installation, the other of the track flanges is subsequently received in the upright slot. The tool also includes a pair of movable rams each mounted on the tool head for linear movement along a transverse direction perpendicular to the longitudinal direction. The rams are spaced apart along the longitudinal direction and straddle opposite sides of the upright stud. The rams have leading tips with cutting edges.

In accordance with this invention, an actuator moves the rams into cutting engagement with the track flange in the upright slot to cut hinged tabs in the track flange, and to bend the hinged tabs into frictional engagement with the opposite sides of the upright stud to connect the upright stud in place to the track. Spacers may be provided for adjustably positioning the rams relative to the track web. The tips bend the hinged tabs with clearance through side passages formed in the tool head. The cutting edge of each tip extends partly around a periphery of each tip to form each hinged tab as a cantilever flap spaced away from a longitudinal edge of the track flange. Preferably, the rams are spaced apart along the transverse direction to sequentially cut and bend the hinged tabs. The hinged tabs advantageously slidably engage the opposite sides of the upright stud to permit relative sliding movement between the upright stud and the track so that the wall system serves as a deflection wall system.

Another aspect of this invention is directed to a method of connecting an upright stud in place to a horizontal, top or bottom, track having a track web extending along a longitudinal direction and track flanges extending away from the track web in a metal stud wall system installation. The method is performed by receiving at least one of the track flanges in an upright slot of a tool head, mounting a pair of movable rams on the tool head for linear movement along a transverse direction perpendicular to the longitudinal direction, spacing the rams apart along the longitudinal direction to straddle opposite sides of the upright stud, configuring the rams with leading tips having cutting edges, moving the rams into cutting engagement with the track flange in the upright slot to cut hinged tabs in the track flange, and bending the hinged tabs into frictional engagement with the opposite sides of the upright stud to connect the upright stud in place to the track.

Thus, the disclosed tool readily and easily converts a standard track for use in installing metal stud wall systems, and the disclosed method quickly and inexpensively installs such metal stud wall systems, especially deflection wall systems.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
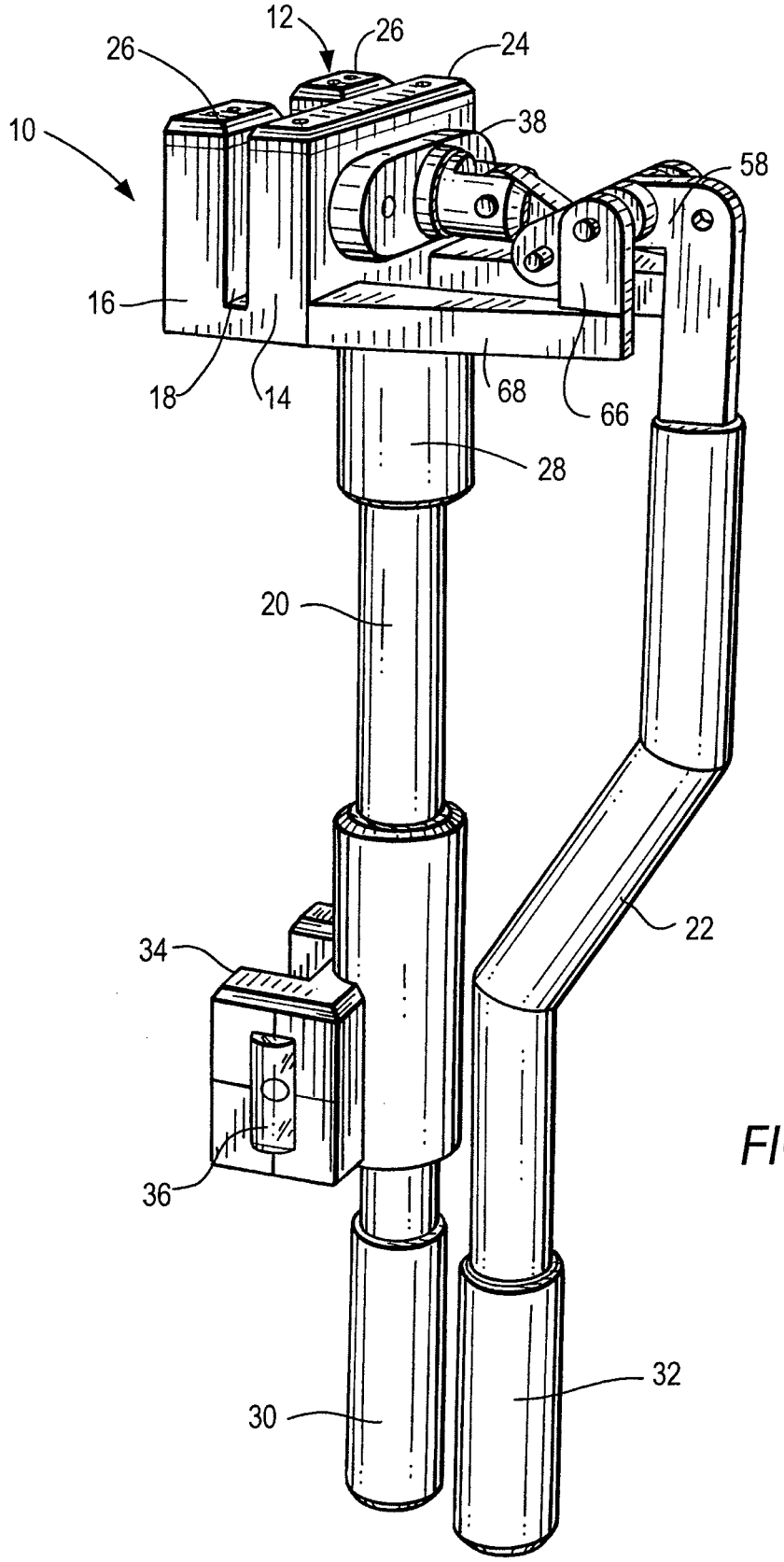
FIG. 1 is a perspective view showing a tool for installing a metal stud wall system in accordance with a method of this invention.
Figure 2:
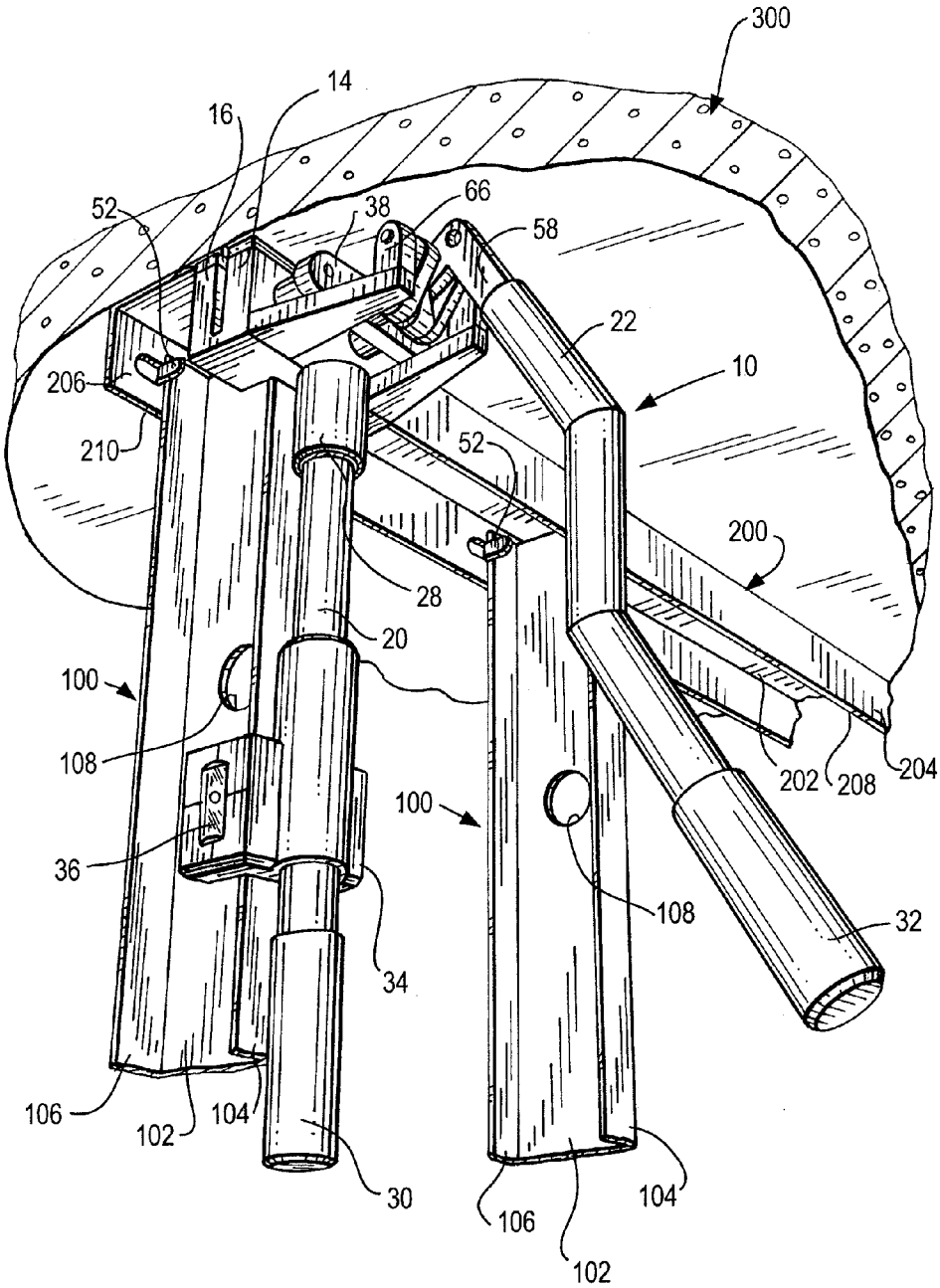
FIG. 2 is a broken-away, perspective view of the tool of FIG. 1 during use, as seen from below.
Figure 3:
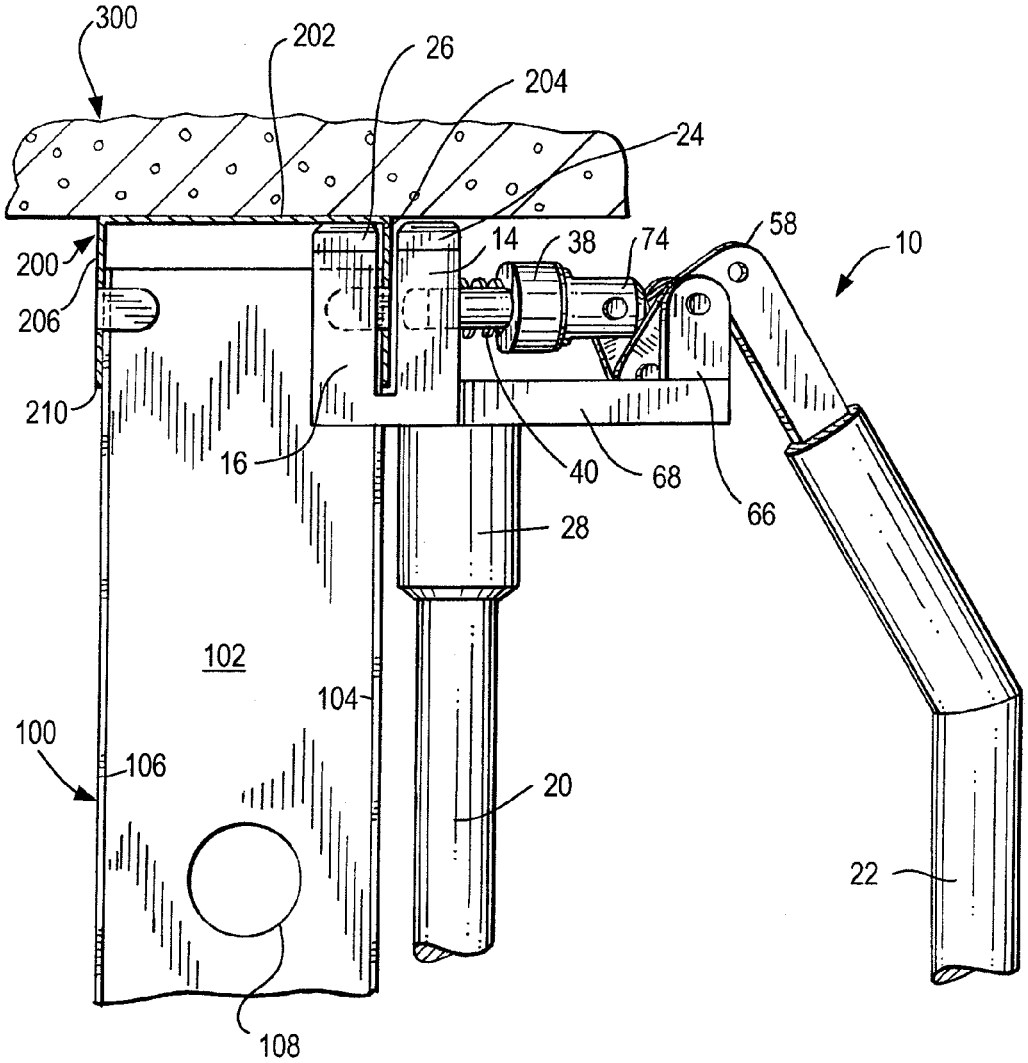
FIG. 3 is a broken-away, end elevational view of the tool of FIG. 1 during use.
Figure 4:
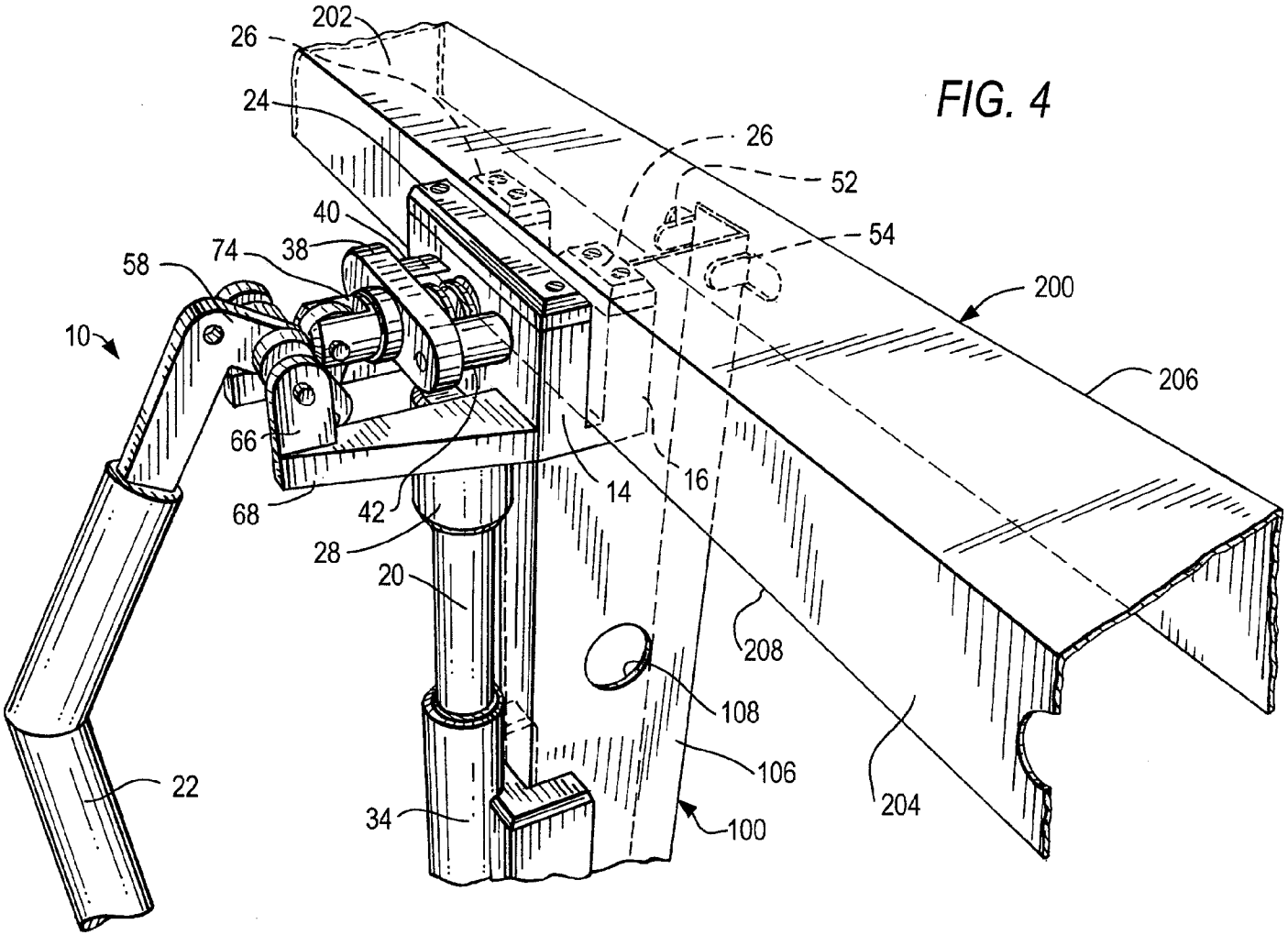
FIG. 4 is a broken-away, perspective view of the tool of FIG. 1 during use, as seen from above.

Referring now to the drawings, reference numeral 10 generally identifies a tool for connecting a vertically elongated, upright metal stud 100 (see FIG. 2) and, preferably, a plurality of spaced-apart upright metal studs 100 (only two shown in FIG. 2 for clarity) in place to, and within, a horizontally elongated, channel-shaped, metal, standard track 200 (see FIG. 2) having a generally planar track web 202 extending along a longitudinal direction and track flanges 204, 206 extending perpendicularly away from the track web 202 in a metal stud wall system installation. The track 200 is shown in FIGS. 2-3 as being a U-shaped, top track secured to an overhead ceiling 300 or analogous overhead framework, and with its track flanges 204, 206 extending downwardly and terminating in longitudinal edges 208, 210. It will be understood that the track 200 could equally well be a bottom track secured to a floor, and with its track flanges 204, 206 extending upwardly and terminating in longitudinal edges 208, 210.

Each stud 100 is likewise standard and channel-shaped, and includes a generally planar stud web 102 extending along a vertical direction and stud flanges 104, 106 extending perpendicularly away from the stud web 102. Each stud is illustrated as having a U-shaped cross-section, but could equally well have other standard cross-sections, such as a C-shape, with each stud flange 104, 106 being L-shaped. The studs 100 often include lateral bores or cutouts 108 through which electrical, plumbing, or other conduits can be routed. The studs 100 are spaced apart lengthwise of the track 100, typically at centerline distances of 16 inches apart.

The tool 10 includes a tool head 12 (best seen in FIG. 7) having a generally planar, guide wall 14 and a pair of spaced-apart, guide walls 16 that lie in a common plane parallel to the guide wall 14. The guide walls 14, 16 bound an upright slot 18 in which one of the track flanges, e.g., 204, is received during use of the tool 10. Subsequently, the other track flange 206 will be received in the upright slot 18, as explained below. One of the guide walls 14, 16 is outside the track 200, whereas the other of the guide walls 14, 16 is inside the track 200, when each track flange is in the slot 18 during tool use.

The tool 10 further includes a stationary tubular handle 20 fixed to the tool head 12 via a tubular collar 28 for supporting the tool head 12, and a movable tubular handle 22 pivotably mounted on the tool head 12 and manually movable relative to the stationary handle 20 between open and closed positions. Friction-enhancing handle grips 30, 32 are advantageously provided at the free ends of the handles 20, 22. A level holder 34 is mounted on the handle 20 and includes a pair of arms that straddle the stud 100 during tool use. An air bubble level 36 is mounted on the holder 34 to indicate when the stud 100 is truly vertical.

A spacer 24 having a predetermined thickness is mounted on the top of the guide wall 14, and a pair of spacers 26 each having a predetermined thickness is mounted on the top of each guide wall 16. By abutting against the inner surface of the track web 202, the spacers 24, 26 control how deeply each track flange 204, 206 is received in the slot 18. The illustrated spacers 24, 26 can be interchanged with other spacers of different thicknesses, or the spacers 24, 26 can be adjustably mounted on the guide walls 14, 16 by turning the illustrated screws.

Figure 5:
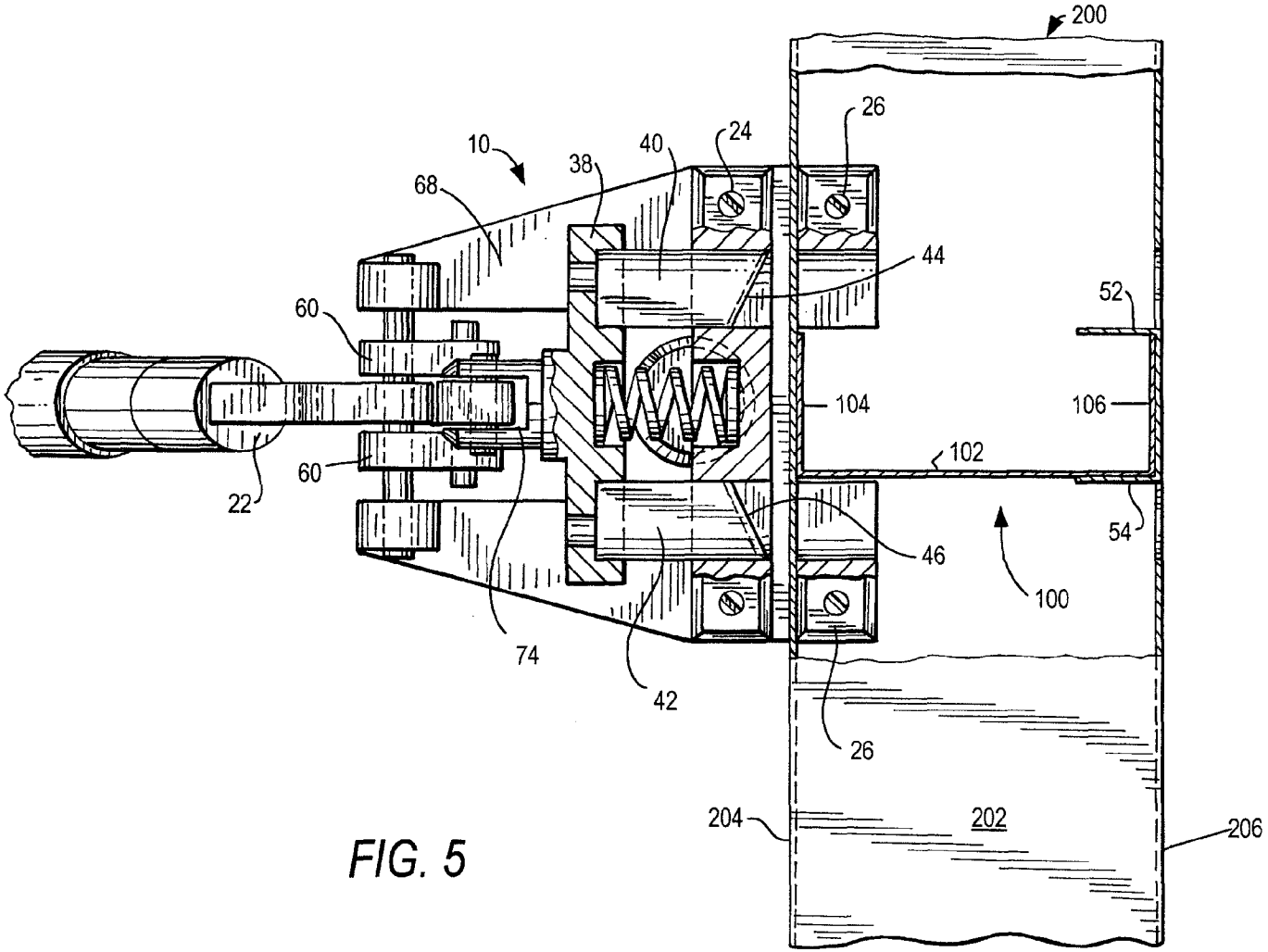
FIG. 5 is a part broken-away, part sectional, top plan view of the tool of FIG. 1 in an open position prior to tab formation.
Figure 6:
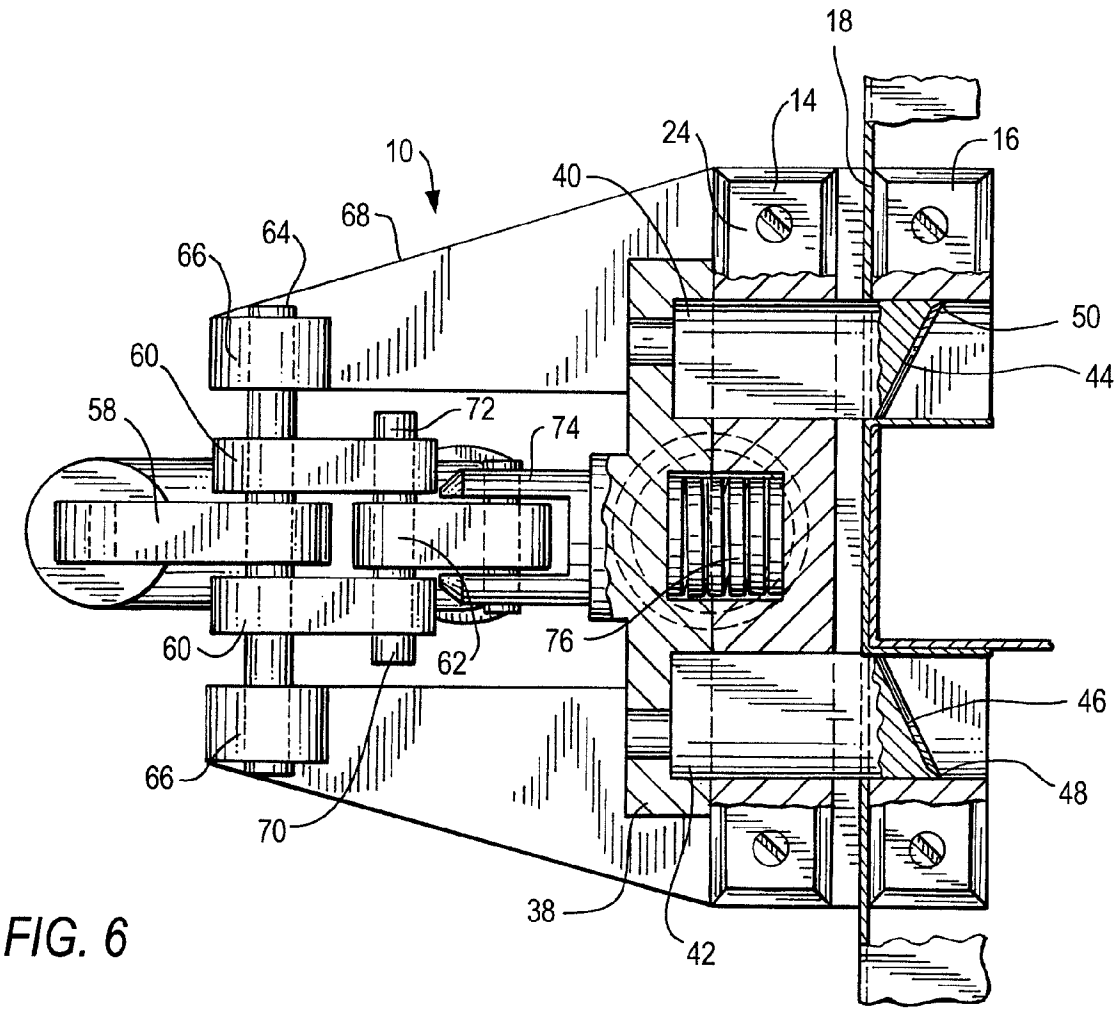
FIG. 6 is a view analogous to FIG. 5, 1 in a closed position after tab formation.
Figure 8:
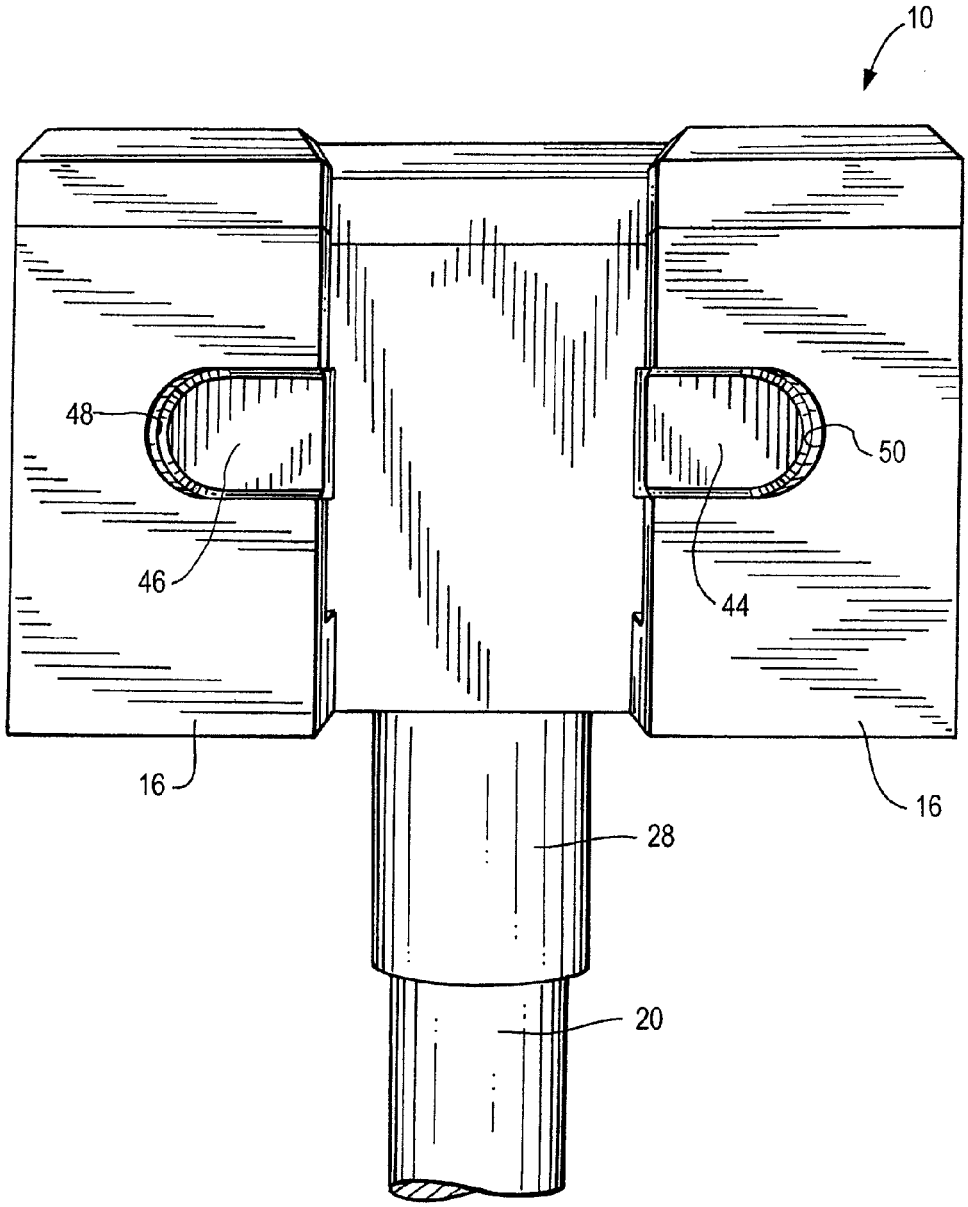
FIG. 8 is an enlarged, front elevational view showing the tool head of FIG. 1.

Two movable, cylindrical rams 40, 42 are commonly mounted on a ram block 38 for joint movement on the tool head 12. As explained below, the rams 40, 42 are mounted for linear movement along a transverse direction perpendicular to the longitudinal direction, i.e., perpendicular to the track flange 204 or 206 received in the slot 18. The rams 40, 42 are spaced apart along the longitudinal direction and straddle opposite sides of the upright stud 100. The rams 40, 42 pass through parallel bores in the guide wall 14, as well as at least partly through parallel passages in the guide walls 16. The rams 40, 42 have tapered leading tips 44, 46 each preferably having a D-shaped cross-section (see FIGS. 5-6). Cutting edges 48, 50 (see FIG. 8) partly surround the tips 44, 46 and can be described as C-shaped. As also shown in FIG. 8, the passages in the guide walls 16 preferably have D-shaped cross-sections and are laterally open and face each other along the linear edges of the D-shaped cross-sections.

An actuator is operative for moving the rams 40, 42 into cutting engagement with the track flange 204 or 206 in the upright slot 18 to cut hinged tabs, such as D-shaped tabs 52, 54, in the track flange, and to bend the hinged tabs 52, 54 into frictional engagement with the opposite sides of the upright stud 100 to connect the upright stud 100 in place to the track 200. The actuator includes the manually movable handle 22 and a transmission between the movable handle 22 and the rams 40, 42 for transmitting movement of the movable handle 22 between open and closed positions to the rams 40, 42.

Figure 7:
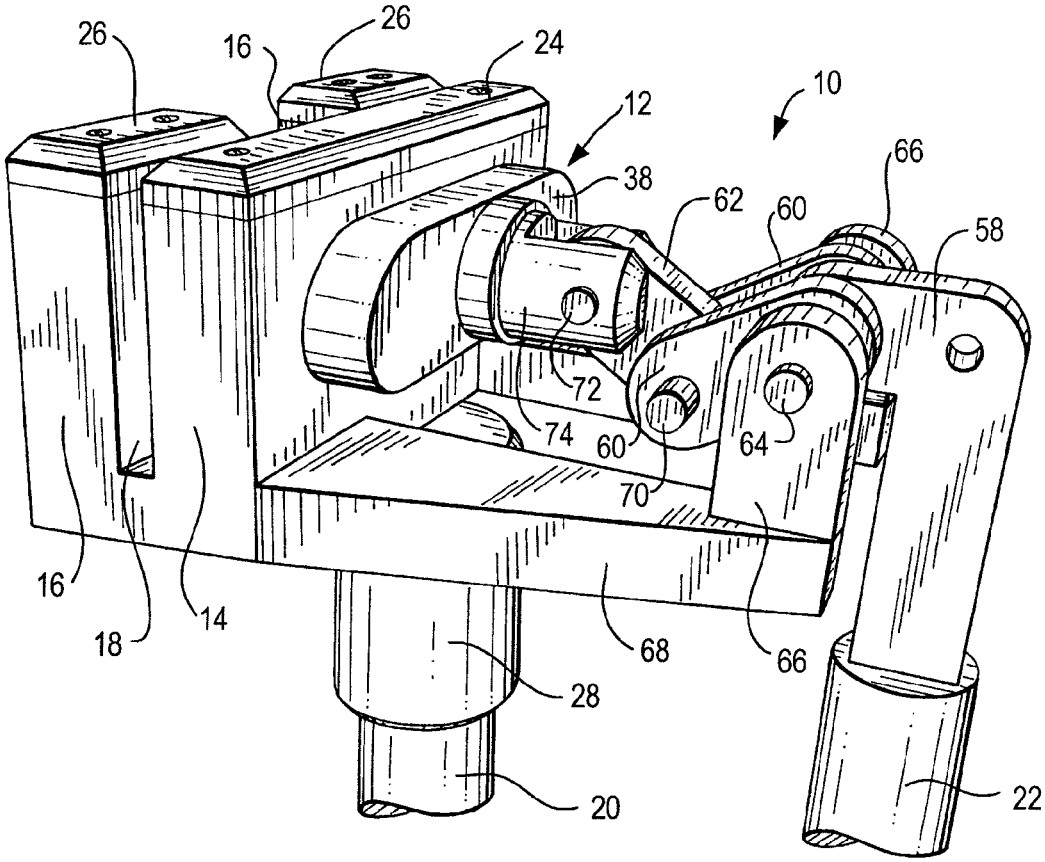
FIG. 7 is an enlarged, perspective view showing the tool head of FIG. 1.

The transmission includes, as best shown in FIG. 7, a bell crank 58 at the upper portion of the movable handle 22, a pair of extensions 60 fixed at opposite sides to the bell crank 58, and a force-transmitting link 62. The crank 58 and one end of each extension 60 are pivotably mounted for joint movement about a shaft 64 that is supported by an upstanding lug 66 on a base 68 to which the guide walls 14, 16 are also fixedly supported. One end of the link 62 is pivotably connected at a shaft 70 to which the opposite ends of the links 60 are pivotably connected. The opposite end of the link 62 is pivotably connected at a shaft 72 supported by a tubular extension 74 that is fixedly connected to the ram block 38. As the handle 22 is turned clockwise in FIG. 7 to the closed position, the closing force of the handle 22 is transmitted via the bell crank 58 and its extensions 60 to the link 62 which, in turn, linearly pushes the ram block 38 and, in turn, the rams 40, 42. A return spring 76 (see FIG. 6) exerts a constant biasing force to return the ram block 38 and the rams 40, 42 to the initial open position.

In use, an installer manipulates the tool 10 so that one of the flanges, e.g., 204, is inserted into the slot 18. The installer could have selected the flange 206 first. The installer checks the bubble level 36 to insure that the stud 100 is vertical. It is assumed that the track 200 is already secured to a building structure, i.e., the ceiling 300 and/or the floor. The spacers 24, 26 abut against the track web 202 and have either preselected or adjusted thicknesses to control the position of the tabs 52, 54, which will be formed by operation of the tool 10, in dependence upon the height (on the order of two inches) of the flange 204. Thus, the spacers 24, 26 position the tabs 52, 54 at a desired spacing away from the track web 202 and from the longitudinal edges 208, 210 of the track 200.

Then, closing the handle 22 pushes the rams 40, 42, as described above, against the restoring force of the return spring 76. During initial movement of the rams 40, 42, the circumferentially-incomplete, C-shaped cutting edges 48, 50 pierce and cut through the flange 204 captured in the slot 18. During subsequent movement of the rams 40, 42, the tapered tips 44, 46 push against and bend the two flange portions of the flange 204 that have been cut by the cutting edges 48, 50 out of the plane of the flange 204 to form the D-shaped, hinged tabs 52, 54. The tips 44, 46 bend the hinged tabs 52, 54 with clearance through the D-shaped side passages of the guide walls 16 until the tabs 52, 54 engage and secure opposite sides of the upright stud 100.

Each hinged tab 52, 54 is a cantilever flap stamped out from the flange 204, while remaining attached thereto by an integral living hinge. The hinged tabs 52, 54 preferably slidably engage the opposite sides of the upright stud 100 to permit relative sliding movement between the upright stud 100 and the track 200. Then, the tool is repositioned to form tabs in the other flange 206 in an analogous manner. This process is then repeated for the remaining studs, each in its turn.

It will be understood that each of the elements described above, or two or more together, also may find a useful application in other types of constructions differing from the types described above. For example, the handles 20, 22 can have telescoping portions to allow the installer to reach the track 200 without requiring a ladder.

Also, it is desirable if the rams 40, 42 are spaced apart along the transverse direction to sequentially cut and bend the hinged tabs. In other words, forming both tabs 52, 54 simultaneously requires a certain muscular effort. By displacing the rams axially apart by a distance of say, 1/16 of an inch, the tabs are formed in sequence, and the required muscular effort is reduced. The tabs 52, 54 themselves need not be D-shaped, but can have many other shapes. The tabs could be formed while the tracks are mounted on the building structure, or in advance of such mounting. Rather than manually moving the rams, a powered motorized drive can be used.

While the invention has been illustrated and described as embodied in a tool for, and a method of, installing a metal stud wall system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A tool for connecting an upright stud in place to a horizontal track having a track web extending along a longitudinal direction and track flanges extending away from the track web in a metal stud wall system installation, comprising:

a tool head having a base, a pair of mutually parallel, generally planar, guide walls fixedly supported on the base and spaced apart to bound an upright slot in which one of the track flanges is received during use of the tool, and a pair of mutually parallel bores extending generally perpendicularly through one of the guide walls to the upright slot along a transverse direction perpendicular to the longitudinal direction;

a pair of movable rams each mounted on the tool head for linear movement along the transverse direction through the bores, the rams being spaced apart along the longitudinal direction and straddling opposite sides of the upright stud, the rams having leading tips with cutting edges; and an actuator for moving the rams through the bores into cutting engagement with the one track flange in the upright slot to cut hinged tabs in the one track flange, and to bend the hinged tabs into frictional sliding engagement with the opposite sides of the upright stud to permit relative sliding movement between the upright stud and the track.

2. The tool of claim 1, and a stationary handle for supporting the tool head; and wherein the actuator includes a movable handle manually movable relative to the stationary handle, and a transmission between the movable handle and the rams for transmitting movement of the movable handle to the rams.

3. The tool of claim 1, wherein the one track flange has a longitudinal edge spaced away from the track web; and wherein the cutting edge of each tip extends partly round a periphery of each tip to form each hinged tab as a cantilever flap spaced away from the longitudinal edge of the one track flange.

4. The tool of claim 1, wherein the tool head has side passages facing each other, and wherein the tips bend the hinged tabs with clearance through the side passages during movement of the rams.

5. The tool of claim 1, wherein the tool head has spacers for adjustably positioning the rams relative to the track web.

6. The tool of claim 1, and a level mounted on the tool for vertically orienting the upright stud during use of the tool.

7. The tool of claim 1, wherein the rams are spaced apart along the transverse direction to sequentially cut and bend the hinged tabs.

8. A method of connecting an upright stud in place to a horizontal track having a track web extending along a longitudinal direction and track flanges extending away from the track web in a metal stud wall system installation, comprising the steps of:

configuring a tool head with a base, a pair of mutually parallel, generally planar, guide walls fixedly supported on the base and spaced apart to bound an upright slot, and a pair of mutually parallel bores extending generally perpendicularly through one of the guide walls to the upright slot along a transverse direction perpendicular to the longitudinal direction;

receiving one of the track flanges in the upright slot of the tool head;

mounting a pair of movable rams on the tool head for linear movement along the transverse direction through the bores, and spacing the rams apart along the longitudinal direction to straddle opposite sides of the upright stud, and configuring the rams with leading tips having cutting edges;

moving the rams through the bores into cutting engagement with the one track flange in the upright slot to cut hinged tabs in the one track flange; and bending the hinged tabs into frictional sliding engagement with the opposite sides of the upright stud to permit relative sliding movement between the upright stud and the track.

9. The method of claim 8, and supporting the tool head with a stationary handle; and wherein the moving and bending steps are performed by manually moving a movable handle relative to the stationary handle, and transmitting movement of the movable handle to the rams.

10. The method of claim 8, and configuring the one track flange with a longitudinal edge spaced away from the track web; and configuring the cutting edge of each tip to extend partly round a periphery of each tip to form each hinged tab as a cantilever flap spaced away from the longitudinal edge of the one track flange.

11. The method of claim 8, and configuring the tool head with side passages facing each other, and wherein the bending step is performed by the tips bending the hinged tabs with clearance through the side passages during movement of the rams.

12. The method of claim 8, and adjustably positioning the rams relative to the track web.

13. The method of claim 8, and vertically orienting the upright stud.

14. The method of claim 8, wherein the moving and bending steps are performed sequentially.

15. The method of claim 8, wherein the track is at least one of a top track and a bottom track.

16. The method of claim 8, wherein all the steps are repeated for the other track flange.

* * * * *